US005920270A

United States Patent [19]

Peterson

[11] Patent Number: 5,920,270

[45] Date of Patent: Jul. 6, 1999

[54] SECURITY SYSTEM REMOTE CONTROL

[75] Inventor: John Peterson, Toronto, Canada

[73] Assignee: Digital Security Controls Ltd., Downsview, Canada

[21] Appl. No.: 08/279,157

[22] Filed: Jul. 22, 1994

[51] Int. Cl.[6] ..... G08B 5/22

[52] U.S. Cl. ..... 340/825.37

[58] Field of Search ..... 340/825.31, 825.32, 340/825.34, 825.37, 827.69, 827.72, 506, 539, 528, 531

[56] References Cited

U.S. PATENT DOCUMENTS

| | | | |
|---|---|---|---|
| 4,021,796 | 5/1977 | Fawcett, Jr. et al. | 340/825.32 |
| 4,189,719 | 2/1980 | Massa et al. | 340/528 |
| 4,581,606 | 4/1986 | Mallory | 340/539 |
| 4,692,762 | 9/1987 | Lewiner et al. | 340/825.31 |
| 4,723,121 | 2/1988 | van den Boom et al. | 340/825.31 |
| 4,772,876 | 9/1988 | Laud | 340/539 |
| 4,786,900 | 11/1988 | Karasawa et al. | 340/825.31 |
| 4,851,708 | 7/1989 | Palmer | 340/825.22 |
| 4,894,649 | 1/1990 | Davis | 340/825.22 |
| 4,908,604 | 3/1990 | Jacob | 340/539 |
| 5,065,151 | 11/1991 | Sandbrand | 340/825.22 |

OTHER PUBLICATIONS

Gutzwiller, Control Networks for the Home, Oct. 1983, Machine Design Magazine, pp. 109–112.

*Primary Examiner*—Michael Horabik

[57] ABSTRACT

The present invention relates to a remote control unit for cooperating with a security system for convenient arming and disarming thereof and/or status thereof. A low cost of remote preferably cooperates with other components of the system to provide feedback to the user as to the state of the system. The remote control can also be used in a simple, non-threatening method of inputting a security code into a receiving device which is manually or otherwise activated.

9 Claims, 1 Drawing Sheet

SECURITY SYSTEM REMOTE CONTROL

FIELD OF THE INVENTION

The present invention relates to security systems and, in particular, relates to improvements to security systems by providing a remote control unit therefore.

BACKGROUND OF THE INVENTION

There are a host of security systems available for protecting homes, offices or designated areas. A typical security system has a keypad closely located by a particular door into the dwelling or area and requires the inputting of a security code to turn the system off within the specified time period upon opening of the designated door. The keypad, in addition to allowing the system to be turned on or off, allows the status of the system to be checked and for the user to input various controls for modifying of the system. For many applications, this arrangement is more than satisfactory and has operated well. However, there are some people who are reluctant to install a security system, in that a certain amount of anxiety can be created when a person enters a protected area because that person must input a security code within a relatively short time period or the system will produce an alarm. Also, these systems suffer from the disadvantage that a person cannot know the status of the system until the person enters and consults the keypad. If there is an alarm condition present inside the premises, then entry may expose the person to dangerous conditions, such as an intruder or a fire.

Many security systems cooperate with a monitoring company and alarm conditions are communicated by the system to the monitoring company over telephone lines. The monitoring company, upon receiving an alarm condition communication, typically contact the police and the situation is investigated. False alarms greatly reduce the proper utilization of the police force and can also influence the manner in which alarm conditions are investigated. Thus, false alarms represent a significant problem in security applications. A high percentage of false alarms are the direct result of improper procedures associated with arming and disarming security systems by authorized users (i.e. the home owners).

Other systems have provided an exterior device which allows the system to be turned on or off. For example, a fixed-position remote security control keypad. With systems of this type, the problem of the very short time period to correctly enter a security code at the keypad is avoided. However, protection of the fixed-position keypad (eg. from weather conditions and even possible sabotage due to its position) makes this solution not totally satisfactory. Also, the cost for exterior systems is prohibitive.

Therefore, the existing systems have certain operating deficiencies, particularly, less expensive security systems such as those for protecting of a home and are not "user friendly" with respect to the arming and disarming function.

SUMMARY OF THE INVENTION

An improved arrangement for accessing and controlling of a security system is taught which includes a portable wireless remote control unit for producing signals which are received by an indoor remote signal receiver associated with the security system and which can at least be used to modify the operation of the security system. In particular, it is desired to be able to turn the system on or off or greatly simplify the disarming thereof.

According to an aspect of the invention, the wireless remote control cooperates with a battery powered receiver which operates in a low power consumption "wait mode" where it waits to receive a power-up signal indicating remote access is being sought. The receiver then changes to an operating mode to complete a certain protocol to confirm that the instructions are authorized. One practical embodiment of this feature is using an infrared signal (preferably slightly below the visible light spectrum) in the remote unit which is directed at a receiver in close proximity thereto. This close proximity could be through a door window or door sidelight to a receiver attached or close thereto and interior to the premise.

According to an aspect of the invention, the indoor remote signal receiver includes a display which can be powered up when the receiver is in the operating mode. The display can be visible to a user, for example through a window, from the exterior of the dwelling or area. In this way, the remote control can selectively power a display to assist the user in going through a particular procedure and produce a particular sequence of signals to effect disarming of the system. With this arrangement, the personal remote control need not produce a number of highly distinct signals but can, in the preferred embodiment, use a very limited number of signals and, in one case, only one signal to effect disarming of the system without necessarily eliminating the entry of security codes. With this system, the user can determine the degree of sophistication desired from a very simple system where the remote control in a very simple manner, i.e. production of a given address signal, can arm and disarm the system, i.e. change the status of the system, to a more sophisticated arrangement where the user, by means of the display or by means of different keys on the remote, proceeds with a particular arming or disarming sequence. With the personal remote control, it is also desirable to be capable of arming the system. For example, some people would prefer to leave the premise, lock the particular door that they have exited from and then with the dwelling basically mechanically secured, arm the security system. The security necessary to arm the system can be less than the security to disarm the system, if desired. The use of the display associated with the receiver makes this convenient and also allows the convenient placing of the indoor remote signal receiver. The display can, in some cases, be the display of the keypad, which also acts as the receiver of the remote control signal.

In yet a further aspect of the invention, the indoor remote signal receiver with display can be made capable of receiving and displaying signal status information from the alarm system and still operate on a low current consumption basis. In essence, the indoor remote signal receiver is made two-way. It can be made to have full functional capability (eg. functioning like the conventional two-way keypad of the alarm system) or only such functional capability as is required. The use of the display in two-way communication with the control panel allows system status information to be displayed to the user prior to entry. If a burglar is present, for example, the display will alert the user of this condition before he enters the premises.

In its preferred form, the personal remote control unit is extremely simple to operate and can be produced in a very cost effective manner. If desired, the personal remote control can be made with a personal security code stored therein and automatically generates the personal security code with each transmission from the remote control unit. Alternatively, if desired, the personal remote control can include a series of actuation keys for inputting of a security code into the personal remote control. The indoor receiver unit can wait in its low power consumption state until activated by receiving a signal from the remote control unit. This is desirable with a battery powered receiver to increase the battery life thereof. If the unit is attached to a door window, the remote may be placed in very close proximity thereto, and results in a strong signal being received.

With the present system, the security system can include its own software for processing of signals received from the remote control and can use different logic arrangements for determining if an unauthorized user might be attempting to determine what the code is. Therefore, it is possible to adapt the security system itself to have a particular software processing arrangement to detect a potential unauthorized use of a remote control unit (indicated, for example, by a number of incorrect codes in a short time period).

In yet a further aspect of the invention, the personal remote control operates on an infrared signal similar to a television remote control. In yet a further aspect of the invention, the remote control is part of a wristwatch. Existing IR wristwatch controls for televisions are now available and these can be used with the security system. As can be appreciated, such controls do include their own input keypad and, thus, the degree of sophistication can be more complex or, if desired, the security system can be programmed to be very simple. With such an arrangement, a more sophisticated security arrangement would be required as the wristwatch control signal is normally not an addressed signal, but security can be maintained by requiring the inputting of a security code. In contrast, a remote control having only one signal would be a signal which has been uniquely identified to the indoor remote signal receiver or security system.

The present invention has particular application for control of the security system from exterior of the premise, but it can also be used to allow fast disarming upon entry to a premise. In this case, a separate switch or any switch on the keypad can be used, if desired, to power-up the system, whereafter the remote control can be actuated to disarm the system. This provides an arrangement which is less stressful to use. Note that the remote could still be used to cause the keypad to power up.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
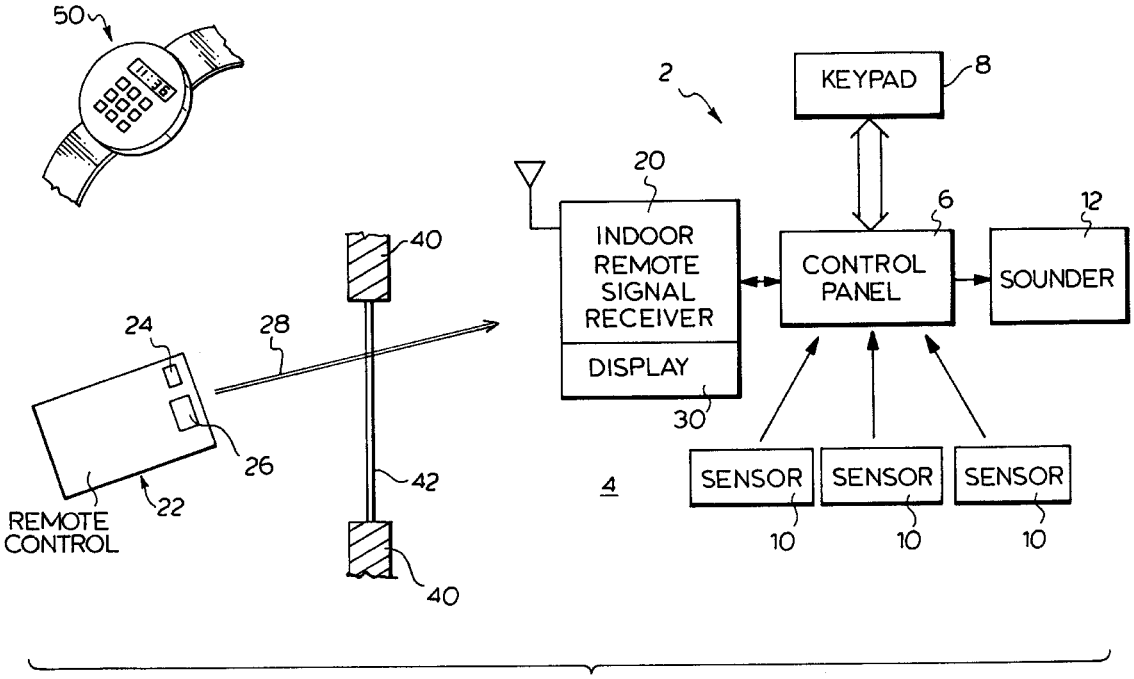
FIG. 1 is a schematic of the system.

A security system generally shown as 2 operates to protect the dwelling or area 4 from unauthorized entry thereto. The security system has a control panel 6 which has two-way communication capability with the keypad 8 and communication with a sounder 12 and also receives communications from the sensors 10. A user interfaces with the security system by means of the keypad 8 and the control panel 6 effects operation of the security system and determines how various signals from the sensors are processed. In some systems, some of these components are combined.

The security system 2 is provided with an indoor remote signal receiver generally indicated as 20 which in the preferred embodiment has associated therewith a visual display 30. An exterior wall 40 is partially shown in FIG. 1 having a window pane 42 disposed in a port in the wall. The indoor remote signal receiver 20, when battery operated, has a low power consumption wait mode and a higher power consumption operating mode, where the various functions for controlling the system may be changed. This two state arrangement conserves power draw.

The personal remote control indicated as 22 is capable of generating a signal or signals indicated as 28 to be received by the indoor remote signal receiver 20. In the preferred form, an infrared signal 28 is transmitted from the exterior of the premises through the window pane 42 and is received by the indoor unit. A first actuator button 24 is provided on the remote control and, in this case, a second actuation button 26 is provided with the control. The signal from the personal remote control can be generated in close proximity to the receiver and cause the receiver to become functional (i.e. power up). In the operating mode, the display and microprocessor and other functions are available.

The user of the remote control 22 can view the display 30 through the window pane 42 or other suitable arrangement. Thus, the person is exterior to the dwelling or area to be protected but can communicate with the indoor remote signal receiver by transmitting signals using his remote control and be forced through a particular sequence of steps by means of prompts being provided on the display 30 or prearranged.

To more clearly understand the operation of the system, a disarming sequence of the security system which is controlled by the remote control 22 will be described. A user positions himself adjacent the window pane 42 such that the display 30 is visible. A first signal is generated by the remote control by pressing actuating button 24. The indoor remote signal receiver, upon receiving of the signal, powers up and then, in this case, recognizes the signal as being generated by a particular remote control. The indoor unit then communicates with the control panel and the control panel sends to the indoor remote signal receiver an appropriate prompt. For example, the prompt could say "enter first code". This first code could be a series of actuations of either of the buttons 24 or 26 or a combination thereof followed by a signal indicating that the code has been entered. For example, the first code might be the number 4 and this could be communicated to the indoor remote signal receiver by pressing button 24 four times following by actuating button 26 once to indicate that the code has been entered and to have the next prompt provided. On the other hand, a single actuation button 24 could enter the code 4 by four short actuations of button 24 followed by a long actuation indicating that the next prompt is required. The display can then provide a second prompt asking the user to enter a second code. As can be appreciated, this system can continue. When the proper code has been entered, the display can say "do you want the system to remain armed" or "disarmed", and again the user can communicate a "yes" or "no" by a particular sequence of actuations of the buttons or a long or short series of actuations of a single button or some other combination. For example, in response to that prompt, a signal from one button 24 could mean "yes" and two short signals from 24 could mean "no". The display could then provide a status report. For example, the system could say "there has been no breach of security and no alarm". This type of status report might even be provided in very simple manner at the start of the system even before entry of any sort of sophisticated code. In such an arrangement, the user would then be alerted if a breach had occurred and could take appropriate action. He might not want to enter the premise at all and merely leave and contact the police. In any event, it can be seen that a very simple remote control 22 which could be very economical to produce can be used in combination with an indoor remote signal receiver which again can use very simple technology and inexpensive technology for receiving the signal and use the sophistication of the control panel for processing of the signal and providing appropriate prompts to the display.

In another embodiment, a personal security code might have been preprogrammed into the remote control unit, such that pushing the single button 24 could cause automatic transmission of the security code whereby to gain access. Additional buttons could be dedicated to arm or disarm.

The invention can also include other transmitters which are available for other purposes. For example, there exists a wristwatch remote control receiver for televisions. With this arrangement, the remote control unit 22 would be the watch 50 which because of its other purpose already includes a multiple button actuation keypad because of its other purpose, the watch, in the most simplified embodiment, would not have its own unique code as its normal purposes for controlling of a television set or VCR or other components. However, it does have the capability of sending different signals based on the various keys that have been actuated. In this way, these general signals can be transmitted to the indoor remote signal receiver which is activated and produces prompts and forces the user to go through a particular sequence for establishing that he is, indeed, an authorized user.

The term display has been used by any light code or audible code sequence is also possible. The display allows user friendly prompting and more sophisticated coding sequences.

The remote control unit 22, if it has its own unique signal 28 and the owner of the security system accepts that anyone in possession of this remote control can arm or disarm the system, i.e. it is similar to a house key where, in effect, possession allows entry to the house, then the remote control would merely need an on/off capability and the display 30 may not be required. The display may be merely a red light/green light indicating that the system is armed or disarmed or may not include any visual indication at all. A status indicator can also be provided. The use of the display 30 does allow a very simple remote control unit to operate in a very simple manner to turn the system on or off or operate in a more sophisticated manner and the security system, in particular the control panel, will allow the user to select the degree of sophistication that he desires. This display could be the keypad display, if desired, and the keypad would act as the additional remote signal receiver. With the system as generally shown in FIG. 1 where a very simple personal remote control is used, each family member can have his own remote control and the degree of sophistication of each remote to allow entry into the system need not be the same. For example, children may be provided with a remote unit calling for the entry of fairly sophisticated security codes. Although they are more likely than adults to lose a remote control unit, such loss would not comprise the security of the home because of the entry code requirements. Even most small children in today's society would not be challenged by this type of technology and could easily control the use of such a more complicated remote control unit. In contrast, an elderly person is less likely to lose the remote control unit, but may be intimidated by security systems in general. Such a user should be provided with a simple on/off type system which allows entry and exit in a more conventional (i.e. key-like) manner. It would be preferred with this type of system that some sort of visual indication that the system was armed or disarmed would be provided.

These remotes can also be assigned certain known time periods or days where they are authorized and the security system does not allow entry at other periods. For example, a housekeeper expected on Tuesday at 9:00 could be given a remote which is only effective for disarming on Tuesday between 8:30 and 9:30. Typically, arming may not require the same security authorization.

With this system, a receiver is activated by a remote control unit and enters a state for receiving a security authorization sequence. The remotes are preferably transmitters only and the receiver provides feedback. The receiver is not always in a full operating state and typically powers up when authorized by the remote. Powering up could also occur by a manual switch, magnetic switch closed by relative movement of the remote and receiver or other arrangements. When the receiver is not battery powered, power consumption is less critical, but a change in state is still preferable.

A variation of the system uses RF transmitters similar to car access remote controls and the control panel of the security system or other hardwired transceiver device which receives and recognizes the signal. A battery powered display can then be activated by a relatively strong signal, many times stronger than the signal of the remote control. In this way, the power requirements of the remote are low and the power consumption of the display are low. The power requirements of the control panel are higher, but this is acceptable as it is always powered or has unlimited power available. Furthermore, the separate display could be avoided if the control panel used a wall powered sounder or any sounder which normally listened for a signal from the control panel.

The present invention allows a low power transmitter to communicate effectively with a security system and provide feedback to the user as to the state of the system. This is accomplished in an energy efficient manner whereby the power requirements of the remote are not excessive and battery powered feedback devices can be used, if desired. In a more sophisticated embodiment, the remote can include a receiver which receives the strong signal from the security system. This could include a full powered receiver/transmitter which screws into a light socket, for example, and thus, is always powered and can receive signals. In this example, the power to turn the light on or off would include a separate control, as will be explained. The light switch could be left on and the keypad used by the user to inform the control panel that the light was to be on or off, which in turn instructs the receiver/transmitter in the power socket, which then connects or disconnects the light. The socket would always be powered if the remote is to be used. The keypad could also be used to cause the control panel not to recognize remote signals but allow a light to be again controlled by the switch. A display could be part of the receiver/transmitter or the light could come on to indicate it is disarmed.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A security system comprising a number of sensors for sensing an alarm condition, a control panel for receiving signals from said sensors and processing the same for determination of an alarm event, an interior keypad for inputting information to said control panel, said security system further comprising a wireless remote control arrangement having a portable unit to be carried by a user and an interior receiver arrangement for receiving signals from said portable unit and communicating with said control panel to alter the status of the security system including arming and disarming of the security system; said portable unit including at least one key actuator and means to generate and transmit a predetermined IR signal in response to actuation of said at least one key actuator, said receiver arrangement upon receipt of said predetermined IR signal from said portable unit providing visual feedback to the user to assist the user in the entry of an identification code produced by means of a series of IR signals produced by multiple actuation of said at least one key actuator and to also assist the user in the entry of instructions to alter the status of the security system, said interior receiver upon receipt of said IR signals to alter the status of the security system instructing said control panel to change the status of the security system in accordance with said received IR signals.

2. A security system as claimed in claim 1 wherein said receiver arrangement and said control panel communicate using a wireless RF communication channel.

3. A security system as claimed in claim 1 wherein said receiver arrangement and said control panel communicate using AC power lines.

4. A security system as claimed in claim 1 wherein said security system includes a plurality of portable units where each unit has its own identifying signal, and said control panel includes means for recognizing each portable unit only during specified time intervals which time intervals are provided to said control panel.

5. A security system as claimed in claim 1 wherein said receiver arrangement includes its own visual display screen which is activated when said predetermined signal of said portable unit is received.

6. A security system as claimed in claim 4 wherein said IR signals of said portable units are highly directional, low power IR signals.

7. A security system as claimed in claim 1 wherein said receiver arrangement and said control panel communicate using a wireless RF communication channel.

8. A security system as claimed in claim 6 wherein said receiver arrangement is powered by AC.

9. A method of arming and disarming a security system wherein the security system has a number of sensors for sensing an alarm condition, a control panel for receiving signals from said sensors and processing the signals for determination of an alarm event, an interior keypad for inputting information to said control panel and a wireless remote control arrangement having a portable unit to be carried by a user and an interior receiver arrangement for receiving directional signals from said portable unit and communicating with said control panel to alter the status of the security system in accordance with signals received from said portable unit, said method comprising generating and transmitting a predetermined IR signal in response to actuation of at least one key actuator of said portable unit, receiving and recognizing said predetermined IR signal at said receiver arrangement and providing visual feedback confirming receipt and recognition of said predetermined IR signal by said receiver arrangement, generating and transmitting further predetermined IR signals in response to multiple actuation of the at least one key actuator of said portable unit to thereby enter an authorization code, receiving and recognizing said further predetermined IR signals at said receiver arrangement and providing visual feedback confirming receipt and recognition of said predetermined IR signals by said receiver arrangement when the authorization code has been received, and thereafter, providing visual prompts to alter the status of the security system, generating additional IR signals by actuating said at least one key actuator of said portable unit in response to said prompts to cause the status of the security system to change, receiving said additional IR signals at said receiver arrangement and instructing said control panel to change the status of said security system in accordance with said additional RF signals; and said control panel effecting the change in status of said security system to arm or disarm the system.

* * * * *